US005847334A

United States Patent [19]

Taga

[11] Patent Number: 5,847,334

[45] Date of Patent: Dec. 8, 1998

[54] SILENCER MECHANISM FOR USE IN AN IMPACT WRENCH

[76] Inventor: Yotaro Taga, 1-11-12, Tsurugamai, Ohi-machi, Iruma-gun, Saitama, Japan

[21] Appl. No.: 703,155

[22] Filed: Aug. 29, 1996

[30] Foreign Application Priority Data

May 21, 1996 [JP] Japan ..... 8-125588

[51] Int. Cl.[6] ..... F01N 3/02

[52] U.S. Cl. ..... 181/230

[58] Field of Search ..... 181/230, 249, 181/250, 251, 255, 257, 229; 173/164, DIG. 2

[56] References Cited

U.S. PATENT DOCUMENTS

| | | | |
|---|---|---|---|
| 2,966,138 | 12/1960 | Quackenbush | 181/230 |
| 3,384,200 | 5/1968 | Baker et al. | 181/230 |
| 4,205,732 | 6/1980 | Auerbach et al. | 181/230 |
| 4,258,798 | 3/1981 | Campbell et al. | 181/230 |

*Primary Examiner*—Khanh Dang
*Attorney, Agent, or Firm*—Jordan and Hamburg

[57] ABSTRACT

A silencer mechanism for an impact wrench can reduce noise of exhaust and increase, rather than decrease, power of an impact wrench. The silencer mechanism comprises a silencer element inserted in an exhaust passage, and an outlet pipe for holding in place the silencer element. The silencer element has larger-diameter tubular portions located at both ends thereof and a smaller-diameter tubular portion located between the larger-diameter tubular portions. A plurality of holes each having a first diameter are formed in the larger-diameter tubular portion located closer to an exhaust inlet such that the holes are equally spaced in the circumferential direction, while a plurality of holes each having a second diameter are formed in the larger-diameter tubular portion located closer to an air outlet such that the holes are equally spaced in the circumferential direction. The outlet pipe is screwed into the exhaust passage so as to hold in place the silencer element inserted in the exhaust passage.

2 Claims, 3 Drawing Sheets

SILENCER MECHANISM FOR USE IN AN IMPACT WRENCH

BACKGROUND OF THE INVENTION

1. Field of the Invention

The present invention relates to a silencer mechanism for use in an impact wrench, and more particularly to such a silencer mechanism which does not decrease power of a motor.

2. Description of the Related Art

FIG. 3 shows an impact wrench disclosed in U.S. Pat. No. 3,605,914. The present invention relates to an improvement in a silencer mechanism for use in such an impact wrench.

As shown in FIG. 3, an impact wrench 1 comprises a nose portion 3, a motor portion 4 using compressed air as a power source, a handle portion 5, and a casing 2. The nose portion 3 has an anvil 6 projecting forward. The motor section 4 has an air motor provided with a driving shaft 7 for driving the anvil 6. The handle portion 5 has a trigger 8, an air inlet 9*a*, and an air outlet 9*b*.

In the impact wrench 1, a silencer provided in the vicinity of the air outlet 9*b* provides a silencing effect by dispersing exhaust through unillustrated sponge or plastic molding. However, the dispersion of exhaust causes back presume to increase, resulting in a power loss of the impact wrench 1.

SUMMARY OF THE INVENTION

An object of the present invention is to provide a silencer mechanism for an impact wrench which can reduce noise of exhaust while increasing, rather than decreasing, power of an impact wrench.

In order to attain the above objective, the present invention provides a silencer mechanism for use in an impact wrench having a handle portion which is provided with both an air inlet and an air outlet at a lower end thereof. The silencer mechanism comprises an exhaust passage, a silencer element inserted in the exhaust passage, and an outlet pipe for holding in place the silencer element. The silencer element has larger-diameter tubular portions located at both ends thereof and a smaller-diameter tubular portion located between the larger-diameter tubular portions. A plurality of holes each having a first diameter are formed in the larger-diamater tubular portion located closer to an exhaust inlet such that the holes are equally spaced in the circumferential direction, while a plurality of holes each having a second diameter are formed in the larger-diameter tubular portion located closer to the air outlet such that the holes are equally spaced in the circumferential direction. The outlet pipe is screwed into the exhaust passage so as to hold in place the silencer element inserted in the exhaust passage.

Preferably, a spherical portion is provided between the exhaust passage and the exhaust inlet. The spherical portion and the exhaust passage merge via a stepped portion, against which one end of the silencer element abuts. External threads are formed at one end of the outlet pipe for engagement with internal threads formed in the exhaust passage. A stepped portion is formed on the internal surface of the outlet pipe, which stepped portion another end of the silencer element abuts against.

According to the present invention, the silencer element inserted in the exhaust passage of the handle portion is composed of the larger-diameter tubular portions located at both end sections thereof and the smaller-diameter tubular portion located between the larger-diameter tubular portions, and holes are formed so as to be equally spaced along the circumference of each larger-diameter tubular portion. Accordingly, a silencing effect is produced by dispersion of air flow through the holes as well as by friction between the dispersion air flow and the inner wall surface of the hand portion.

Since there also exists a high-speed air flow within the smaller-diameter tubular portion, the decelerated dispersion air flow is again accelerated by the high-speed air flow, thereby reducing the back pressure of the motor section. Thus, there can be expected a corresponding increase in motor power as compared with the case of a conventional silencer.

DESCRIPTION OF PREFERRED EMBODIMENT

Figure 1:
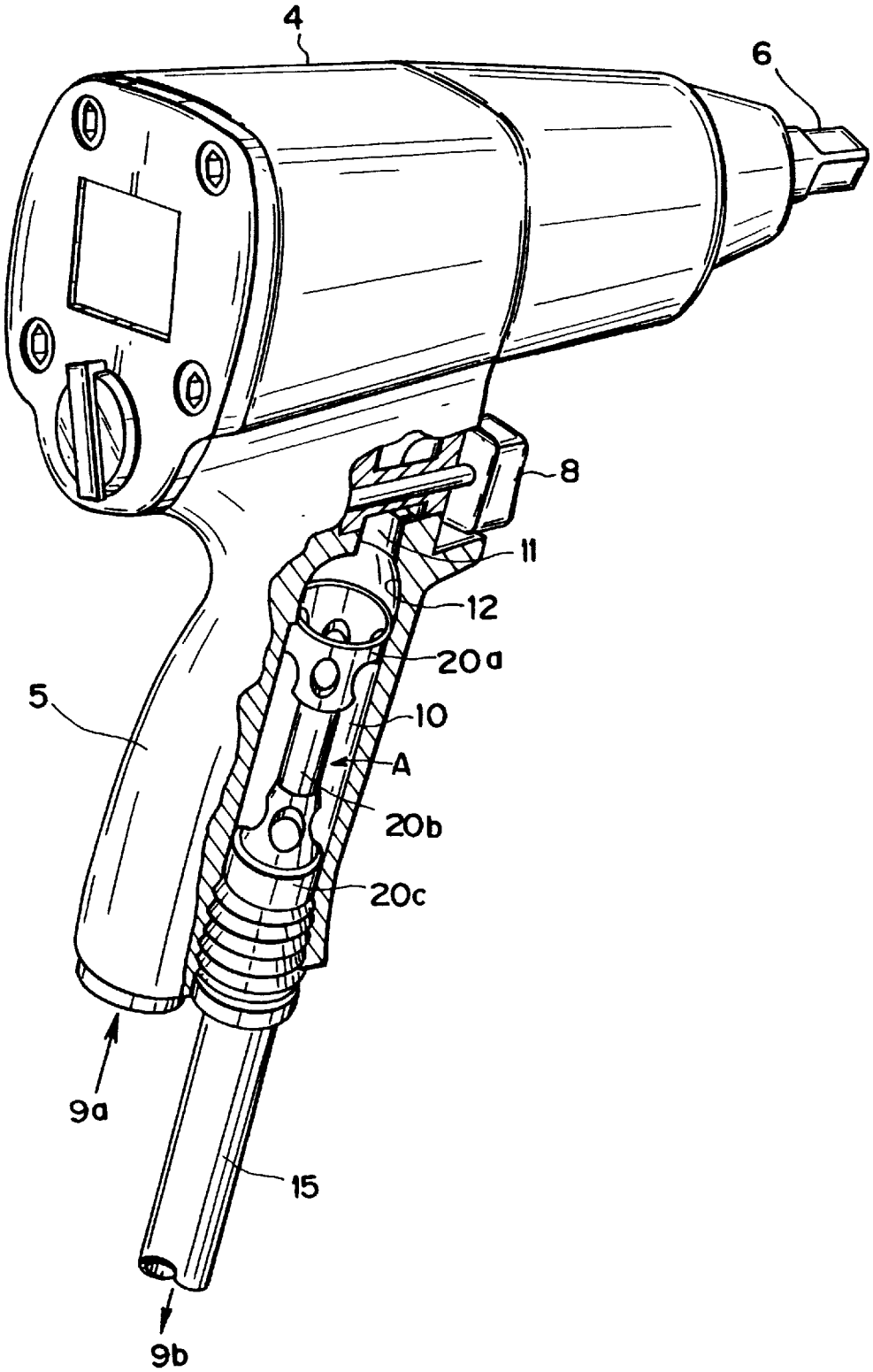
FIG. 1 is a perspective view of an impact wrench provided with a silencer mechanism according to an embodiment of the present invention.
Figure 2:
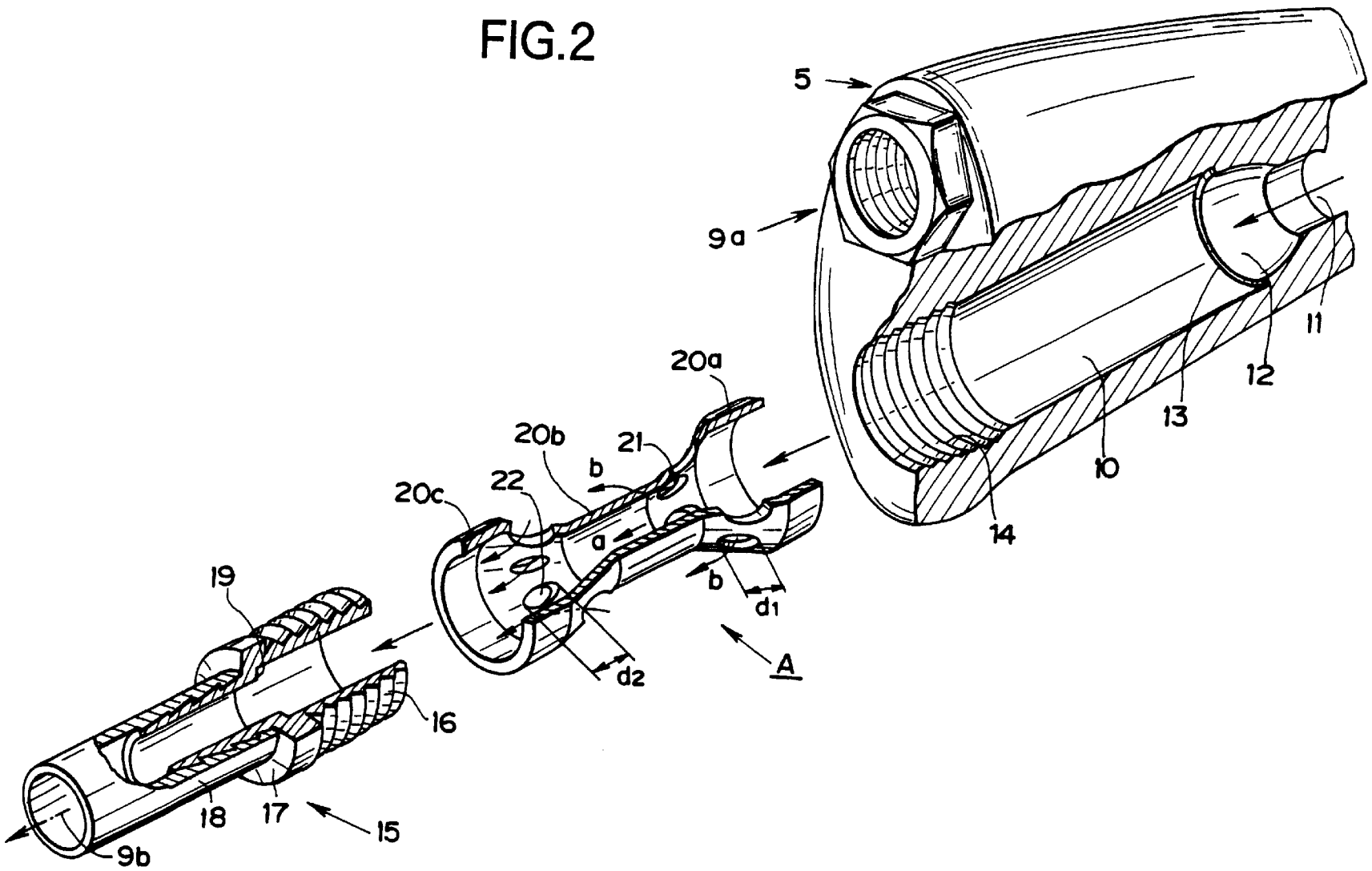
FIG. 2 is an exploded perspective view of a handle portion of the impact wrench of FIG. 1.
Figure 3:
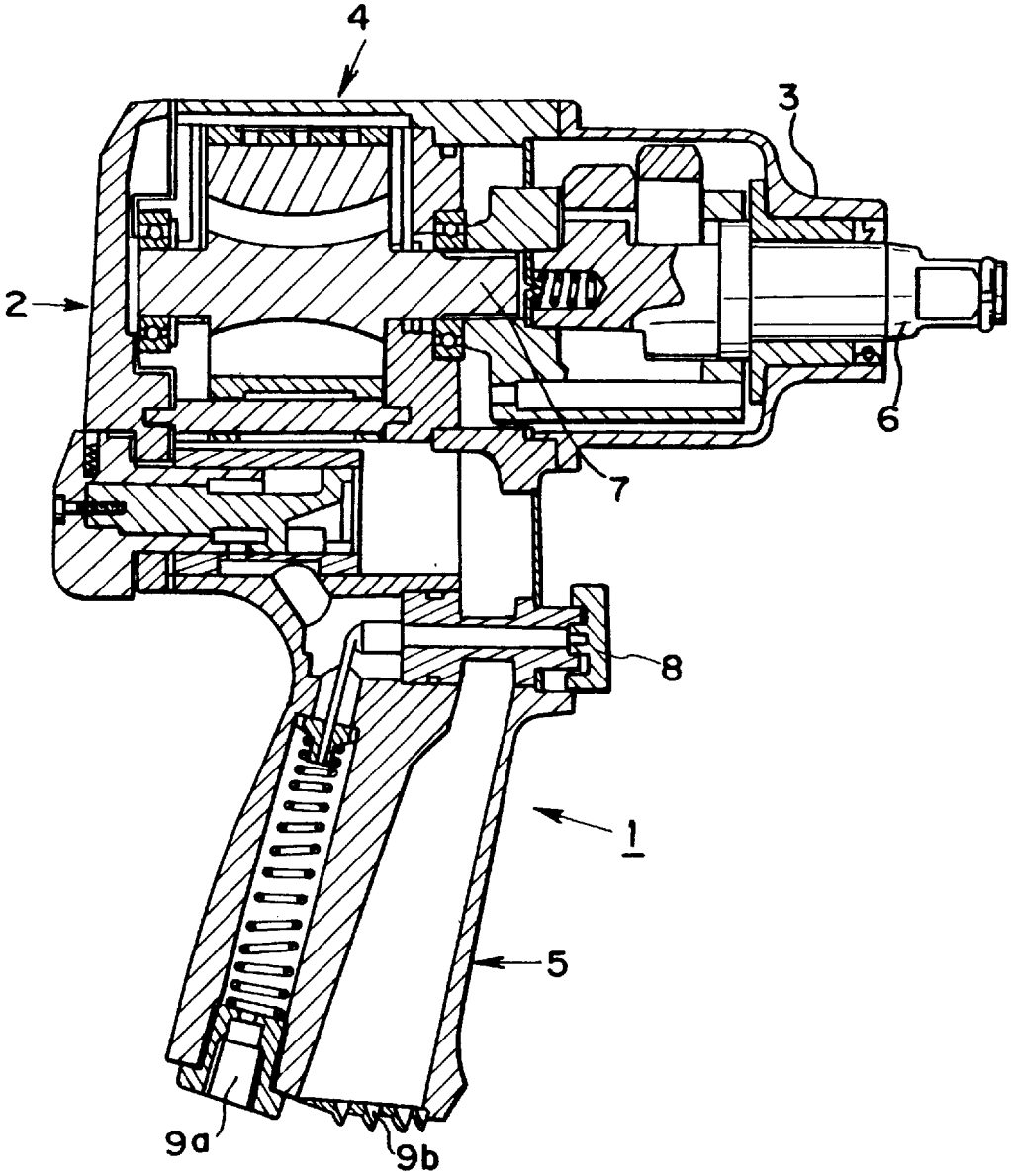
FIG.3 (PRIOR ART)
FIG. 3 is a cross-sectional view of a conventional impact wrench.

An embodiment of the present invention will now be described with reference to FIGS. 1 and 2. As shown in FIG. 1, an air inlet 9*a* and an air outlet 9*b* which is parallel to the air inlet 9*a* are formed in a handle portion 5. A silencer element A according to the present invention is disposed within the handle portion 5 in the vicinity of the air outlet 9*b*.

The silencer element A will now be described in detail with reference to FIG. 2. Reference numeral 10 denotes an exhaust passage provided in the handle portion 5 and having a cylindrical shape. Reference numeral 11 denotes an exhaust inlet 11 having a diameter smaller than the exhaust passage 10. The exhaust inlet 11 merges into the exhaust passage 10 via a spherical portion 12. The spherical portion 12 and the cylindrical exhaust passage 10 define an exhaust expansion chamber. A stepped portion 13 is formed at the boundary between the exhaust passage 10 and the spherical portion 12. The width of step of the stepped portion 13 is equivalent to the wall thickness of the silencer element A. Internal threads are formed in the exhaust passage 10 at its outlet portion.

Reference numeral 15 denotes an outlet pipe. The outlet pipe 15 has an external thread 16 which is formed at one end thereof for engagement with an internal thread 14 of the exhaust passage 10. The outlet pipe 15 also has a hose connecting portion 18 which is continued to the external thread 16 via a flange 17. Reference numeral 19 denotes a stepped portion which is formed on the internal surface of the outlet pipe 15 so as to abut the corresponding end of the silencer element A, thereby holding the silencer element A in place.

Both end portions of the silencer element A have an outer diameter which is substantially equal to the diameter of the exhaust passage 10. The silencer element A has larger-diameter tubular portions 20*a* and 20*c* located at both ends thereof and a coaxial smaller-diameter tubular portion 20*b* located between the larger-diameter tubular portions 20*a* and 20*c*. A plurality of, for example, six holes 20 are formed in the larger-diameter tubular portion 20*a* such that the holes 20 are equally spaced in the circumferential direction. Similarly, a plurality of, for example, six holes 21 are formed the larger-diameter tubular portion 20*c* such that the holes 21 are equally spaced in the circumferential direction. The numbers of the holes 20 and 21 are mere an example, and the present invention is not limited thereto. The diameter $d_1$ (for example, approximately 3.5 mm) of the holes 21 is preferably larger than the diameter d2 (for example, approximately 3 mm) of the holes 22.

The silencer element A is inserted into the exhaust passage 10 of the handle portion 5 until the end of the larger-diameter tubular portion 20*a* abuts the stepped portion 13. Then, the outlet pipe 15 is screwed into the handle portion 5 so that the end of the larger-diameter tubular portion 20*c* abuts the stepped portion 19, thereby fixing the silencer element A in place.

Entering the handle portion 5 through the exhaust inlet 11, exhaust air passes through the spherical portion 12 and then enters the larger-diameter tubular portion 20*a* of the silencer element A located within the exhaust passage 10, which serves as an expansion chamber. In the exhaust passage 10, the flow of exhaust air disperses as illustrated by arrows a and b. The arrow a indicates exhaust air which flows through the smaller-diameter tubular portion 20*b* along the axis of the silencer element A, while the arrows b indicate exhaust air which flow out from the larger-diameter tubular portion 20*a* through the holes 21. Since the smaller-diameter tubular portion 20*b* has a reduced diameter, exhaust air flowing therethrough has a relatively large velocity. By contrast, exhaust air which flows out through the holes 21 hits against the wall surface of the exhaust passage 10, flows through a space defined by the outer surface of the smaller-diameter tubular portion 20*b* and the wall surface of the exhaust passage 10, and then reenters the silencer element A through the holes 22 formed in the larger-diameter tubular portion 20*c*. Thus merged exhaust air flows out into the outlet pipe 15.

Due to dispersion through and change of direction by the holes 21 as well as friction with the wall surface of the exhaust passage 10, exhaust air flowing outside the smaller-diameter tubular portion 20*b* is decelerated, thereby providing a silencing effect. The decelerated exhaust air flow reenters the silencer element A through the holes 22 formed in the larger-diameter tubular portion 20*c* and merges into the high-speed exhaust air flow coming from the smaller-diameter tubular portion 20*b*. Thus merged exhaust air flows out into the outlet pipe 15. Accordingly, in addition to the silencing effect, because of reacceleration of the decelerated exhaust air flow by the high-speed exhaust air flow coming from the smaller-diameter tubular portion 20*b*, a smooth flow of exhaust air is not disturbed, whereby power of the motor portion 4 is not decreased.

What is claimed is:

1. A silencer mechanism for use in an impact wrench having a handle portion which is provided with both an air inlet and an air outlet at a lower end thereof, said silencer mechanism comprising:

a silencer element inserted in an exhaust passage communicating with said air outlet; and an outlet pipe screwed into a threaded portion of said exhaust passage so as to hold in place said silencer element inserted in said exhaust passage, wherein said silencer element comprises:

larger-diameter tubular portions located at both ends of said silencer element;

a smaller-diameter tubular portion located between said larger-diameter tubular portions;

a plurality of holes each having a first diameter which are formed in the larger-diamater tubular portion located closer to an exhaust inlet such that said holes are equally spaced in the circumferential direction; and a plurality of holes each having a second diameter which are formed in the larger-diameter tubular portion located closer to said air outlet such that said holes are equally spaced in the circumferential direction.

2. A silencer mechanism for use in an impact wrench according to claim 1, wherein a spherical portion is provided between said exhaust passage and said exhaust inlet such that the connecting portion between said spherical portion and said exhaust passage has a stepped portion, against which one end of said silencer element abuts, and the internal surface of said outlet pipe has a stepped portion, against which another end of said silencer element abuts.

* * * * *